US012366391B2

(12) United States Patent
De Albuquerque et al.

(10) Patent No.: US 12,366,391 B2
(45) Date of Patent: Jul. 22, 2025

(54) REFRIGERATOR APPLIANCE WITH FLEXIBLE PRE-CONDENSER COIL

(71) Applicant: WHIRLPOOL CORPORATION, Benton Harbor, MI (US)

(72) Inventors: Alexandre Oliveira De Albuquerque, Joinville (BR); Tiago Deived Fagundes, Joinville (BR); Helena Goettems, Joinville (BR); Ana Paula Moscato Malavazi, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 313 days.

(21) Appl. No.: 17/892,725

(22) Filed: Aug. 22, 2022

(65) Prior Publication Data

US 2024/0060692 A1 Feb. 22, 2024

(51) Int. Cl.
*F25B 39/04* (2006.01)
*F25D 21/14* (2006.01)

(52) U.S. Cl.
CPC ..... *F25B 39/04* (2013.01); *F25D 21/14* (2013.01); *F25D 2321/1412* (2013.01)

(58) Field of Classification Search
CPC ..... F25D 21/14; F25D 2321/144
See application file for complete search history.

(56) References Cited

U.S. PATENT DOCUMENTS

| | | | | |
|---|---|---|---|---|
| 5,966,958 | A * | 10/1999 | Maynard | F25D 21/14 62/277 |
| 6,393,854 | B1 * | 5/2002 | Scheuer | F25D 21/14 62/277 |
| 7,003,973 | B2 | 2/2006 | Lee et al. | |
| 2014/0044569 | A1 | 2/2014 | Kremer et al. | |
| 2015/0308731 | A1 * | 10/2015 | Viklund | F28F 17/00 29/890.03 |
| 2020/0300525 | A1 | 9/2020 | Jacobi | |
| 2022/0135809 | A1 * | 5/2022 | Kaiser | C09D 5/1693 106/15.05 |
| 2023/0184480 | A1 * | 6/2023 | Chauhan | F25D 23/006 62/77 |

* cited by examiner

*Primary Examiner* — Elizabeth J Martin
(74) *Attorney, Agent, or Firm* — Brooks Kushman P.C.

(57) ABSTRACT

A refrigeration system of a household appliance including a compressor, a drip pan configured to collect evaporator condensate, and a pre-condenser. The pre-condenser includes a coil extending from the compressor and having a deformable section and a nondeformable section, wherein the deformable section is disposed between the drip pan and the compressor, and at least a portion of the nondeformable section is disposed in the drip pan such that heat from the coil aids in evaporation of the condensate.

15 Claims, 4 Drawing Sheets

REFRIGERATOR APPLIANCE WITH FLEXIBLE PRE-CONDENSER COIL

TECHNICAL FIELD

The present disclosure relates to a refrigerator appliance having a pre-condenser.

BACKGROUND

In order to keep food fresh, a low temperature must be maintained within a refrigerator appliance to reduce the reproduction rate of bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

According to one embodiment, a refrigeration system of a household appliance including a compressor, a drip pan configured to collect evaporator condensate, and a pre-condenser. The pre-condenser includes a coil extending from the compressor and having a deformable section and a nondeformable section, wherein the deformable section is disposed between the drip pan and the compressor, and at least a portion of the nondeformable section is disposed in the drip pan such that heat from the coil aids in evaporation of the condensate.

According to another embodiment, a refrigerator appliance includes a compressor defining an outlet, an evaporator, a drip pan having a bottom and opposing first and second sidewalls, a drain tube configured to carry liquid water formed at the evaporator to the drip pan, and a pre-condenser. The pre-condenser includes a coil having a first section connected to the outlet and a second section disposed in the drip pan such that the coil extends along the bottom between the first and second sidewalls. The first section has an elbow at the outlet and the first section extends from the elbow, completely across the compressor, and to the second section such that the first section is vertically bendable at the elbow to facilitate assembly of the drip pan.

According to yet another embodiment, a refrigeration system of a household appliance includes a compressor, a condenser, a drip pan configured to collect evaporator condensate, and a pre-condenser. The pre-condenser includes a coil extending from the compressor to the condenser, wherein a section of the coil is disposed in the drip pan. An anti-microbial sleeve is received on the section of coil and having an outer surface disposed against the drip pan to separate the section of coil from the drip pan.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
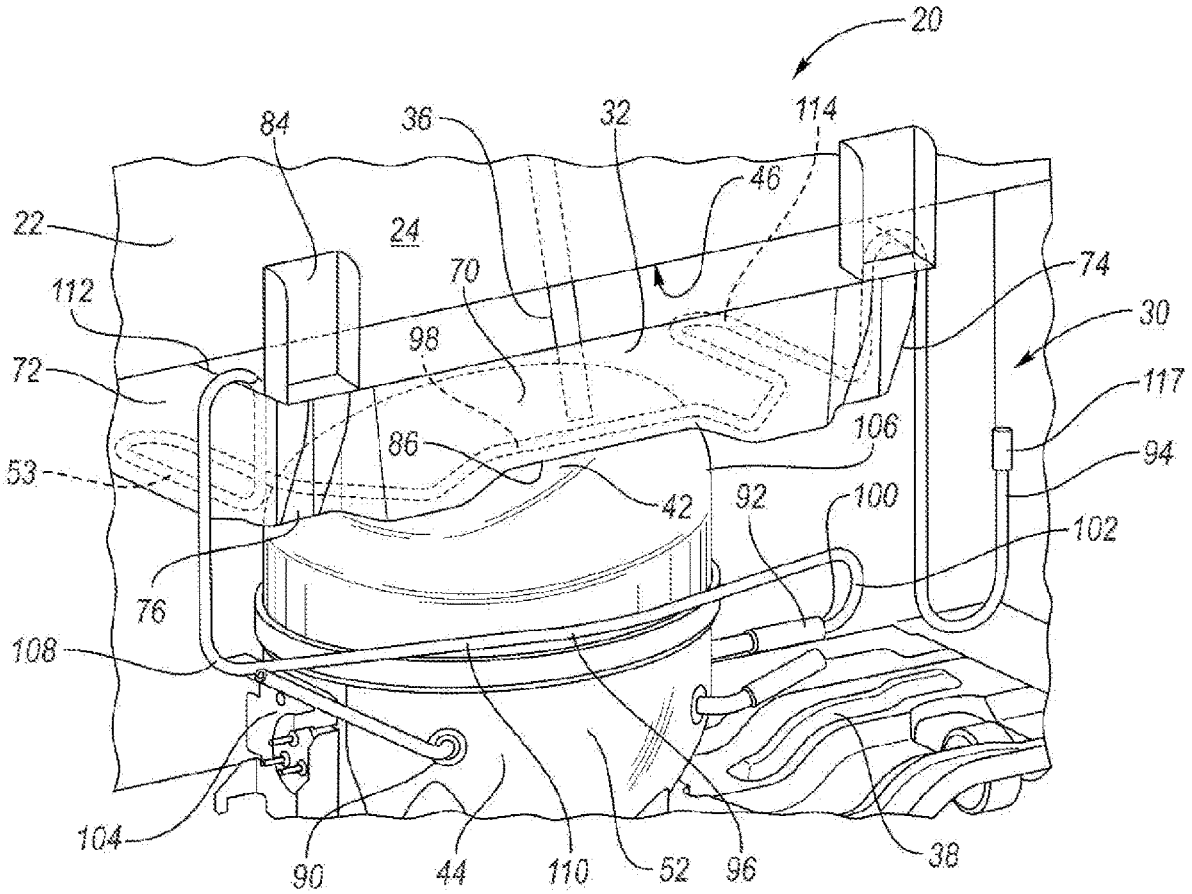
FIG. 1 illustrates a back view of a refrigerator applicant with a back cover omitted to show a machine compartment.

Referring to FIG. 1, generally a refrigerator appliance 20 includes a front, a back 24, sides, a top, and a bottom. The appliance 20 may include a refrigerator compartment and a freezer compartment. The compartments are defined by one or more liners of the appliance 20. The one or more liners may be formed of plastic or other suitable material. The one or more liners are encased by exterior panels 22 of the appliance 20, which may collectively be referred to as a cabinet. An insulating material, such as an insulating foam, may be disposed between the exterior panels and the liner(s) to reduce heat transfer with the ambient surroundings and increase the efficiency of the appliance 20. The compartments are open on the front to provide access. One or more doors open and close the compartments. The one or more doors may be pivotally connected to the front of the cabinet or may be pullout doors, e.g., slide open and closed.

Figure 2:
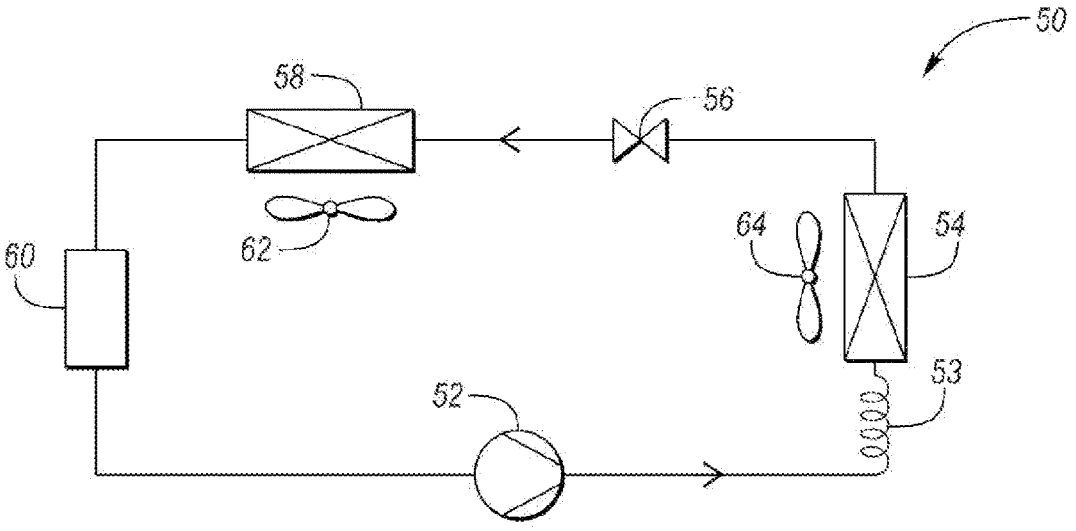
FIG. 2 is schematic diagram of a heat pump system of the refrigerator appliance.

Referring to FIG. 2, one or more vapor-compression heat pump systems 50, which are also known as refrigeration systems, thermally regulate the appliance 20. The heat pump 50 is configured to circulate a refrigerant, e.g., R-134a, in order to cool one or more compartments of the appliance 20. The heat pump 50 includes at least a compressor 52, a pre-condenser 53 (which may be used to warm a component), a main condenser 54 that rejects heat to ambient surroundings, a thermal expansion device 56, an evaporator 58 that cools air being delivered to the refrigerator compartment and/or the freezer compartment, and an accumulator 60. The pre-condenser 53 may be a coil. Of course, the heat pump 50 may include additional components as is known in the art. Fans 62, 64 may be utilized to direct air across the evaporator 58 and the condenser 54 to facilitate heat exchange. The appliance 20 may include air ducts that circulate cold air to the various compartments of the appliance. The arrangement of the air ducts depends upon the number of evaporators provided. In one embodiment, the heat pump 50 includes a single evaporator, e.g., evaporator 58, that is responsible for cooling all of the compartments. Here, the air ducts are configured to circulate the cold air from the evaporator 58 to all of the compartments as needed.

In an alternative arrangement, multiple evaporators are used to directly cool an associated one or more compartments thus reducing or eliminating the need for air ducts. Multiple evaporators may be provided by either adding additional evaporators to a single heat pump or using multiple, separate heat pumps.

Components of the heat pump, e.g., the compressor 52 and the fans 62, 64, may be connected to a controller. Sensors that measure the air temperature within the compartments may also be in communication with the controller. The controller may be configured to operate the compressor 52, fans 62, 64, duct valves, etc. in response to the air temperature within the compartments being outside of thresholds or in response to a user changing the state of the convertible compartment. Such a controller may be part of a larger control system and may be controlled by various other controllers throughout the appliance 20, and one or more other controllers can collectively be referred to as a "controller" that controls various functions of the appliance 20 in response to inputs or signals to control functions of the appliance 20. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the appliance 20.

Referring back to FIG. 1, the appliance 20 includes a machine compartment 30 that may be accessible from the back 24 of the appliance 20. One or more components of the heat pump 50 may be disposed in the machine compartment 30. For example, the compressor 52 and the condenser 54 (not shown) may be located within the machine compartment 30. A drip pan 32 associated with the evaporator 58 may also be disposed in the machine compartment 30. The drip pan 32 is configured to collect condensate formed on the evaporator 58 and store the water for evaporation back to the atmosphere. A drain tube 36 may be provided to carry the liquid water condensed at the evaporator 58 to the drip pan 32.

The compressor 52 may be attached on a bottom bracket 38 of the appliance 20. The compressor 52 may have a generally cylindrical shape having a top 42 and a cylindrical side wall 44. The drip pan 32 may be disposed above compressor 52 and below a ceiling 46 of the machine compartment 30. The drip pan 32 may include a bottom 70, a pair of opposing sidewalls 72, 74, and a pair of opposing front and back walls 76, 78 (See FIG. 3A). The walls extend upwardly from the bottom 70 to form an open enclosure for storing the water. The front wall 76 may include a pair of mounting tabs 84 securing the drip pan 32 to the top of the machine compartment 30. The drain tube 36 may extend downwardly from the evaporator 58, which is located above the machine compartment 30, to within the drip pan 32. The bottom 70 may be contoured to define a pocket 86 configured to receive the top 42 of the compressor 52 therein. This may reduce the height requirements of the machine compartment 30 resulting in a more compact package.

The compressor 52 includes an inlet 90 and an outlet 92 each configured to connect with refrigerant lines 94, e.g., metal tubing. The metal tubing may be steel, copper, or the like. The pre-condenser 53 may be at least partially disposed within the drip pan 32 to facilitate evaporation of the stored water. The pre-condenser 53 may be a coil of tubing that extends from the outlet 92, through the drip pan 32, and to the condenser 54 or to a refrigerant line that extends to the condenser 54.

The pre-condenser 53 includes a flexible or deformable section 96 that is disposed outside of the drip pan 32 and a nondeformable section 98 that is disposed within the drip pan 32. As will be explained in more detail below, the deformable section 96 is movable to facilitate assembly of the drip pan 32 to the appliance 20. The deformable section 96 includes a first end 100 is coupled to the outlet 92 of the compressor 52. The first end 100 is located at or near an elbow 102, which may be a 180° elbow. The deformable section 96 extends completely across the width of the compressor 52 passed a far side 104 of the compressor that is opposite the side 106 having the outlet 92. This may create a segment 110 of the section 96 that is substantially horizontal and traversing the width of the compressor 52. A second elbow 108, e.g., 90°, is located at an end of the segment 110 and bends the deformable section 96 vertically towards the drip pan 32. The deformable section 96 may connect to the nondeformable section 98 near a top edge 112 of the sidewall 72. The nondeformable section 98 then extends downwardly along an inside surface of the sidewall 72 towards the bottom 70. From there, the nondeformable section 98 meanders along the bottom 70, including one or more serpentines or bends 114, to the opposite side wall 74. The nondeformable section 98 may be spaced above the bottom 70 such that the bottom 70 and the nondeformable section 98 do not touch. At the sidewall 74, the nondeformable section 98 and again extends vertically upward up and over the upper edge 116 of the sidewall 78 and terminates at a fitting 117. The fitting 117 is connected either directly or indirectly to the main condenser 54.

The above-described pre-condenser 53 may provide advantages during the assembly process. For example, with this design, the drip pan 32 may be placed with a minimized gap between the compressor 52 and the ceiling of the machine compartment 30. This design also allows for the pre-condenser to be installed including the welding of all tubes prior to insertion of the drip pan 32. The deformable section 96 allows the pre-condenser 53 to be moved, post attachment, so that the drip tray may then be installed above the compressor 52. One example of this process is illustrated in FIGS. 3A to 3C.

Figure 3A:
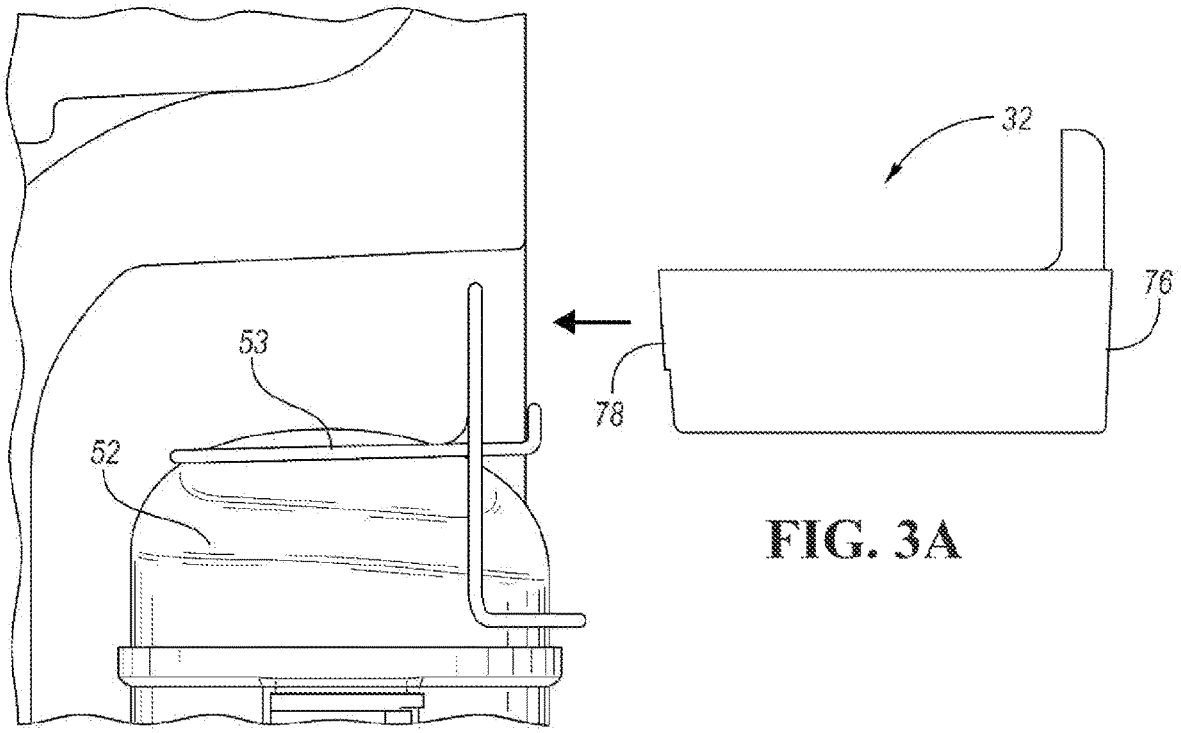
FIGS. 3A-3C illustrate an assembly sequence for installing a drip pan into the machine compartment of the appliance.
Figure 3B:
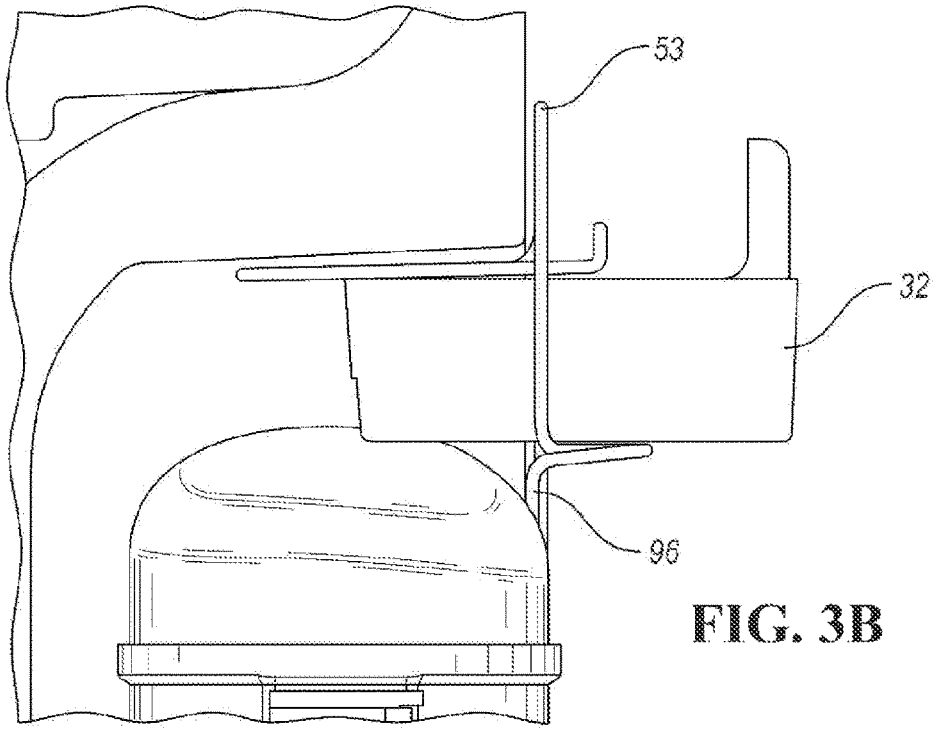
Figure 3C:
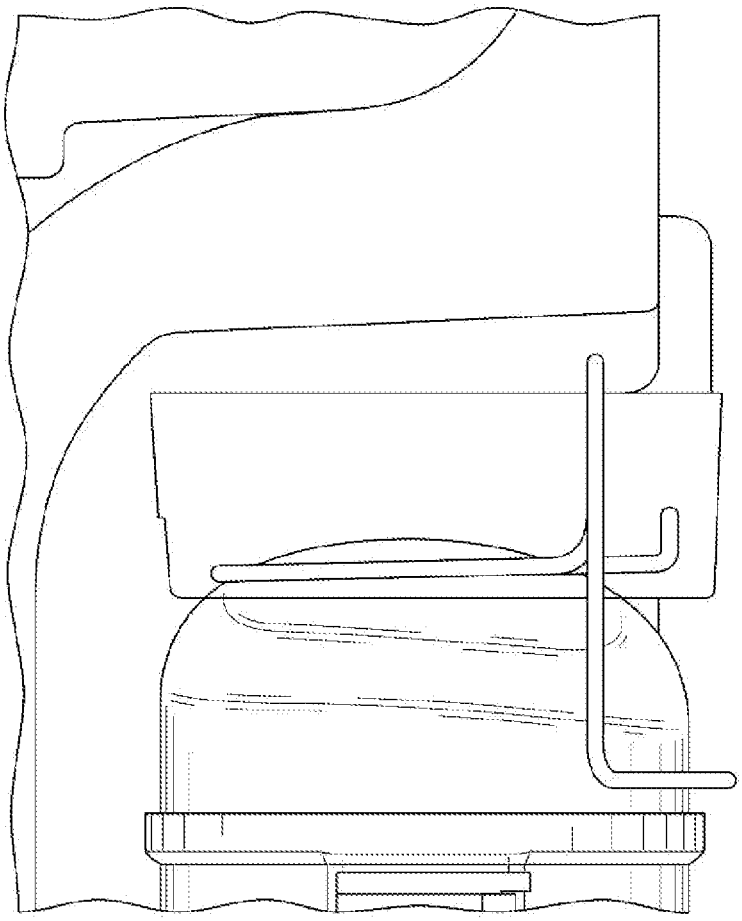

FIG. 3A shows a stage of manufacture in which the compressor 52 and the pre-condenser 53 are installed in the machine compartment 30 of the appliance 20 with all welds associated with the pre-condenser 53 complete. FIG. 3B shows the lifting of the pre-condenser 53 to allow for assembly of the drip pan 32. The pre-condenser 53 may be lifted upwardly and out-of-the-way of the drip pan 32 due to the inclusion of the deformable section 96. For example, the deformable section 96 may be bent at the first elbow 102 from the resting position, e.g., 180°, to a deformed position that is less than 180°, such as 130°, for example. (See FIG. 4). This causes the segment 110 to transition from substantially horizontal to angled, thus allowing the nondeformable section 98 to move upwardly and out-of-the-way of the drip pan 32. The drip pan 32 can then be installed by inserting the drip pan 32 between the top of the compressor 52 and the ceiling of the machine compartment 30. Once the drip pan 32 is properly positioned, it is secured in the machine compartment 30, such as by fasteners or the like. The pre-condenser 53 may be then lowered into the now installed drip pan 32 by moving the deformable section 96 back to the position shown in FIG. 1. For example, the first bend 102 is returned to the approximately 180° position to again place the segment 110 horizontally.

Installing the drip pan 32 post welding may be advantageous. For example, the drip pan 32 may be a plastic component that has limited heat resistance particularly at the temperatures required to join the tube sections of the pre-condenser 53 to each other and to the compressor 52. By fully assembling the pre-condenser 53 prior to insertion of the drip pan 32, the risk of damaging the drip pan 32 is eliminated. The deformable section 96 may also provide robustness during the shipping and handling of the appliance 20 by enabling movement of the pre-condenser 53 without overly stressing any of the welds or joints. The deformable section 96 also allows for consistent and proper positioning of the nondeformable section 98 within the drip pan 32. For example, placing the nondeformable section 98 in close proximity to the bottom of the drip pan 32 facilitates complete evaporation of the collected water. The deformable section 96 also allows for easier service of the drip pan 32 by allowing a broken drip pan 32 to be removed and replaced with a new one without requiring any disassembly of the heat pump 50.

Figure 4:
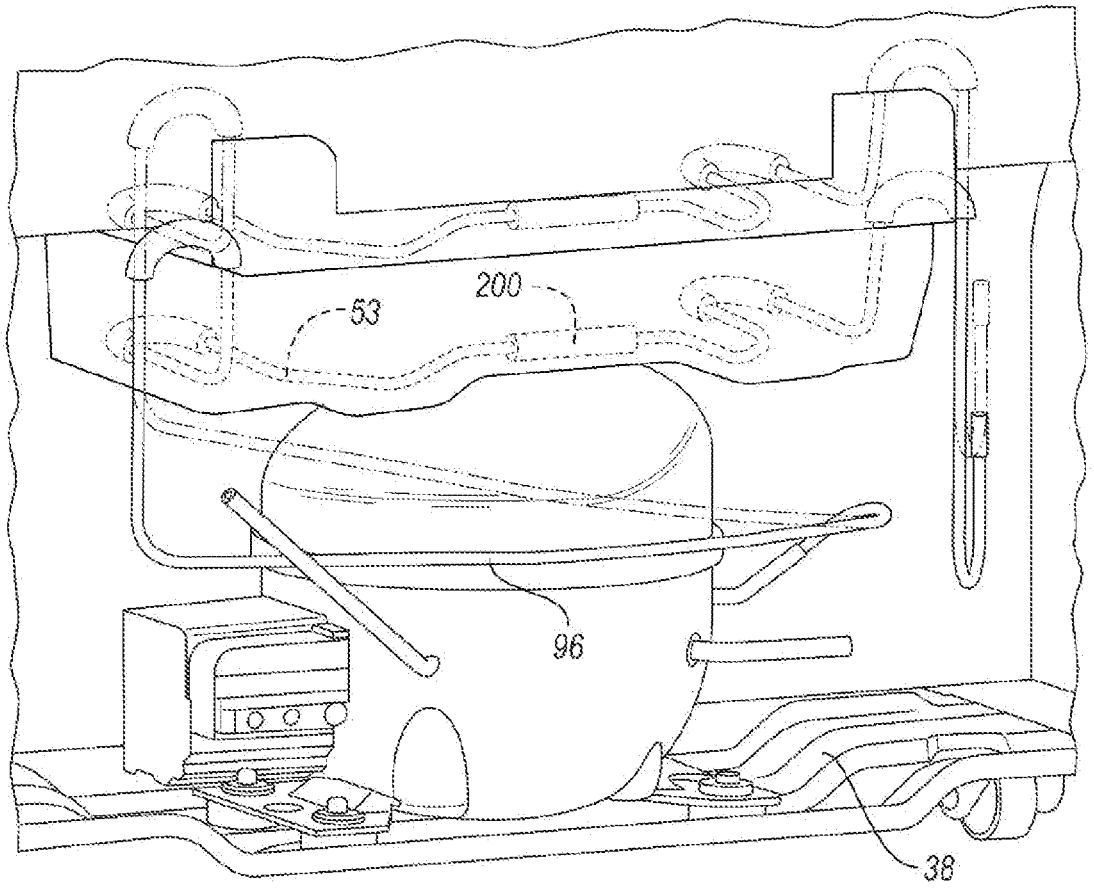
FIG. 4 illustrates a back view of a refrigerator appliance with a back cover omitted to show a machine compartment according to an embodiment that includes sleeves received on a pre-condenser.
Figure 5:
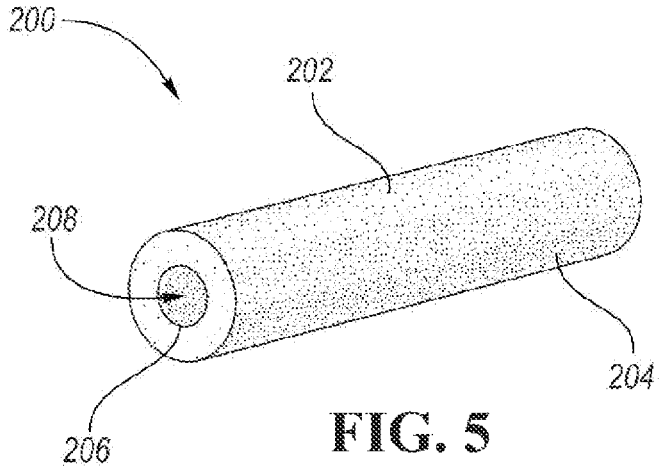
FIG. 5 illustrates a perspective view of the sleeve.

Referring to FIGS. 4 and 5, the pre-condenser 53 may be fitted with one or more optional sleeves 200. The sleeves 200 separate the pre-condenser 53 from the drip pan 32. The sleeves 200 inhibit contact between the metal tubing of the pre-condenser 53 and the drip pan 32, which may reduce noise and inhibit wear. Each sleeve 200 may have a cylindrical body 202 with an outer circumferential surface 204 and an inner circumferential surface 206. The inner circumferential surface 206 defines a hole 208 that extends the length of the cylindrical body 202. The sleeves 200 are received on the pre-condenser 53 by inserting the tubing of the pre-condenser 53 through the hole 208. The sleeves 200 provide a gap around the pre-condenser 53 by having the outer circumferential surface 204 engage with surrounding objects, such as the drip pan 32.

The sleeves 200 may be placed in locations where contact between the pre-condenser 53 and the drip pan 32 is likely. For example, one or more sleeves may be provided at the upper edges of the drip pan 32. The sleeves 200 may also be placed on portions of the pre-condenser 53 adjacent to the bottom of the drip pan 32. The sleeves 200 are designed to be in contact with water. For example, the sleeves 200 may be formed of an anti-microbial material that is resistant to odor, mold, fungus, mildew, and/or the like. In one or more embodiments, the sleeve 200 may be formed of anti-microbial foam. The sleeves 200 may be formed of a flexible material so that they may be placed at ends of the pre-condenser 53. As shown in the illustrated embodiment, four of the sleeves 200 are located at bends such as at the top edges of the drip pan 32 and at the bends of the coil disposed along the bottom of the drip pan 32.

While the sleeves 200 are described in conjunction with a pre-condenser 53 having a deformable section 96, the sleeves 200 could also be used in conjunction with an inflexible coil. The sleeves 200 may also be used to space the pre-condenser 53 from objects other than the drip pan 32. For example, the top and side walls of the machine compartment 30, the shell of the compressor 52, the drying filter, and other tubes located in the machine compartment 30.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A refrigeration system of a household appliance comprising:

a compressor;

a drip pan configured to collect evaporator condensate; and a pre-condenser including a coil extending from the compressor and having a deformable section and a nondeformable section, wherein the deformable section is disposed between the drip pan and the compressor, and at least a portion of the nondeformable section is disposed in the drip pan such that heat from the coil aids in evaporation of the condensate, and wherein a sleeve is received on the nondeformable section and in contact with the drip pan, an outer surface of the sleeve is disposed against an upper edge of the drip pan.

2. The refrigeration system of claim 1, wherein the drip pan is disposed above the compressor.

3. The refrigeration system of claim 2, wherein the drip pan includes a bottom defining a pocket, and a top of the compressor is disposed in the pocket.

4. The refrigeration system of claim 1, wherein the coil is made of steel.

5. The refrigeration system of claim 1, wherein the drip pan includes a bottom and opposing first and second sidewalls extending upwardly from the bottom, and the nondeformable section extends from the first sidewall to the second sidewall.

6. The refrigeration system of claim 5, wherein the drip pan includes a bottom defining a pocket, and a top of the compressor is disposed in the pocket.

7. The refrigeration system of claim 1, wherein the nondeformable section includes at least one serpentine.

8. A refrigerator appliance comprising:

a compressor defining an outlet;

an evaporator;

a drip pan including a bottom and opposing first and second sidewalls;

a drain tube configured to carry liquid water formed at the evaporator to the drip pan; and a pre-condenser including a coil having a first section connected to the outlet and a second section disposed in the drip pan such that the coil extends along the bottom between the first and second sidewalls, wherein the first section includes an elbow at the outlet and the first section extends from the elbow, completely across the compressor, and to the second section such that the first section is vertically bendable at the elbow to facilitate assembly of the drip pan, and wherein an anti-microbial sleeve is received on the second section and having an outer surface disposed against the drip pan to separate the second section of coil from the drip pan, the outer surface of the sleeve is in contact with the bottom of the drip pan to support the second section above the bottom.

9. The refrigerator appliance of claim 8, wherein the second section extends from a top of the first sidewall to a top of the second sidewall.

10. The refrigerator appliance of claim 8, wherein the bottom defines a pocket, and a top of the compressor is disposed in the pocket.

11. A refrigeration system of a household appliance comprising:

a compressor;

a condenser;

a drip pan configured to collect evaporator condensate;

a pre-condenser including a coil extending from the compressor to the condenser, wherein a section of the coil is disposed in the drip pan; and an anti-microbial sleeve received on the section of coil and having an outer surface disposed against the drip pan to separate the section of coil from the drip pan.

12. The refrigeration system of claim 11, wherein the drip pan includes a bottom and at least one sidewall extending up from the bottom, and wherein the outer surface of the sleeve is in contact with the bottom to support the section of the coil above the bottom.

13. The refrigeration system of claim 12, wherein the coil includes an elbow extending over the sidewall, and further comprising a second sleeve received on the elbow and disposed against a top edge of the sidewall.

14. The refrigeration system of claim 11, wherein the drip pan includes a bottom defining a pocket, and a top of the condenser is disposed in the pocket.

15. The refrigeration system of claim 11, wherein the section of the coil is non-deformable, and the coil further includes a deformable section extending from the condenser to the section of the coil that is nondeformable.

* * * * *